US010696311B2

(12) United States Patent
Lou et al.

(10) Patent No.: US 10,696,311 B2
(45) Date of Patent: Jun. 30, 2020

(54) FULL SIDE OPENABLE BOXCAR

(71) Applicant: CRRC QIQIHAR ROLLING STOCK CO., LTD., Heilongjiang (CN)

(72) Inventors: Lianhua Lou, Heilongjiang (CN); Haishuang Sun, Heilongjiang (CN); Fenghui Yu, Heilongjiang (CN); Haizeng Tian, Heilongjiang (CN); Qian Lv, Heilongjiang (CN); Wei Cheng, Heilongjiang (CN); Jian Zhao, Heilongjiang (CN); Shengkun Wang, Heilongjiang (CN); Hua Li, Heilongjiang (CN)

(73) Assignee: CRRC Qiqihar Railing Stock Co., Ltd. (CN)

( * ) Notice: Subject to any disclaimer, the term of this patent is extended or adjusted under 35 U.S.C. 154(b) by 424 days.

(21) Appl. No.: 15/545,341

(22) PCT Filed: Aug. 24, 2016

(86) PCT No.: PCT/CN2016/096528

§ 371 (c)(1),
(2) Date: Jul. 21, 2017

(87) PCT Pub. No.: WO2017/113830

PCT Pub. Date: Jul. 6, 2017

(65) Prior Publication Data

US 2018/0001909 A1 Jan. 4, 2018

(30) Foreign Application Priority Data

Dec. 29, 2015 (CN) ..... 2015 1 1017142

(51) Int. Cl.

| | |
|---|---|
| ***B61D 19/00*** | (2006.01) |
| ***B61D 3/00*** | (2006.01) |
| ***E05F 15/00*** | (2015.01) |

(52) U.S. Cl.

CPC ..... *B61D 19/001* (2013.01); *B61D 3/00* (2013.01); *B61D 19/007* (2013.01); *E05F 15/00* (2013.01);

(Continued)

(58) Field of Classification Search

CPC .. B61D 19/001; B61D 19/003; B61D 19/005; B61D 19/007; B61D 19/009; B61D 3/00; E05F 15/00

See application file for complete search history.

(56) References Cited

U.S. PATENT DOCUMENTS 2,030,773 A * 2/1936 Thomas ..... B61D 17/04 410/141
4,068,411 A * 1/1978 Bodinger ..... B61D 19/00 49/408

(Continued)

FOREIGN PATENT DOCUMENTS

CH 486350 A 2/1970
CN 200957819 Y 10/2007

(Continued)

OTHER PUBLICATIONS

International Patent Application No. PCT/CN2016/096528: International Search Report dated Oct. 31, 2016, 16 pages.

*Primary Examiner* — Jason C Smith
(74) *Attorney, Agent, or Firm* — BakerHostetler

(57) ABSTRACT

A full side openable boxcar is provided according to the present application, which includes multiple doors movable in a direction of a body of the boxcar, and opening and closing devices each being configured to activate the opening and closing of the respective doors; in a closing state, the doors are arranged sequentially to form one side wall of the full side openable boxcar, and opening is required, the opening and closing devices activate the doors to translate in an inner-outer direction, to allow the doors to be staggered (Continued)

and moved in a longitudinal direction of the car body to open the corresponding position of the full side openable boxcar. The design of a door assembly is optimized so as to improve the simplicity and flexibility of door opening and closing, thereby ensuring the improvement in cargo loading and unloading efficiency.

13 Claims, 7 Drawing Sheets

(52) U.S. Cl.
CPC ... *E05Y 2201/422* (2013.01); *E05Y 2201/644* (2013.01); *E05Y 2201/686* (2013.01); *E05Y 2900/51* (2013.01)

(56) References Cited

U.S. PATENT DOCUMENTS 9,487,065 B2 * 11/2016 Bender ..... E05F 11/525
2001/0032417 A1 * 10/2001 Degelman ..... E05D 15/1002 49/214
2010/0011987 A1 * 1/2010 Forbes ..... B61D 17/08 105/406.1
2017/0327132 A1 * 11/2017 Huck ..... B61D 3/00
2018/0001909 A1 * 1/2018 Lou ..... B61D 3/00

FOREIGN PATENT DOCUMENTS

| | | | |
|---|---|---|---|
| CN | 201136500 | Y | 10/2008 |
| CN | 203294104 | U | 11/2013 |
| CN | 105270420 | A | 1/2016 |
| CN | 105480238 | A | 4/2016 |
| DE | 29712961 | U1 | 8/1998 |
| DE | 202009017513 | U1 | 3/2010 |
| FR | 2053571 | A6 | 4/1971 |
| JP | 2014-189040 | A | 10/2014 |
| KR | 20040026025 | A | 3/2004 |

* cited by examiner

FULL SIDE OPENABLE BOXCAR

This application is the national phase of International Application No. PCT/CN2016/096528, titled "FULL SIDE OPENABLE BOXCAR", filed on Aug. 24, 2016 which claims the priority to Chinese Patent Application No. 201511017142.X titled "FULL SIDE OPENABLE BOXCAR", filed with the Chinese State Intellectual Property Office on Dec. 29, 2015, the entire disclosures of which applications are incorporated herein by reference.

FIELD

The present application relates to the technical field of railway boxcars, particularly to a full side openable boxcar.

BACKGROUND

Boxcars are common vehicles in railway wagons, and are widely used in transportation of various cargoes. With the continuous development of railway wagons in China, higher and higher requirements are imposed on rapid and convenient cargo loading and unloading of boxcars.

In the conventional technology, the boxcar is generally provided with a single door structure at a middle part of the car body. Only through the single door, can the loading and unloading be performed during the cargo handling. Since the car body of the boxcar is long and an amount of cargoes to be handled is large, with the boxcar employing such a structure, an opening space formed when the door is opened is small and the door is opened in a fixed position. And it is required to push and deliver cargoes at the door to two ends of the boxcar, which is time-consuming and laborious, thus resulting in a low loading and unloading efficiency.

In view of this, a technical issue to be addressed presently by those skilled in the art is to optimize the design of a door assembly of the boxcar, to allow it to be opened and closed simply and flexibly, and provide convenience for cargo loading and unloading.

SUMMARY

An object of the present application is to provide a full side openable boxcar, a door assembly of which is optimally designed so as to improve the simplicity and flexibility of opening and closing of the door, thereby ensuring the improvement in efficiency of cargo loading and unloading.

A full side openable boxcar is provided according to the present application, which includes multiple doors movable in a longitudinal direction of a car body of the boxcar, and opening and closing devices each being configured to activate the opening and closing of the doors; in a closing state, the doors are arranged sequentially to form one side wall of the full side openable boxcar, and in an opening state, the opening and closing devices activate doors to translate in an inner-outer direction, to allow the doors to be staggered and moved in the longitudinal direction of the car body to open the corresponding position of the full side openable boxcar.

Optionally, the opening and closing device includes:

an upper drive mechanism arranged above the door to push an upper part of the door to translate in the inner-outer direction;

a lower drive mechanism arranged below the door to push a lower part of the door to translate in the inner-outer direction; and a middle drive mechanism which is connected to the upper drive mechanism at one end, and connected to the lower drive mechanism at another end, the middle drive mechanism driving the upper drive mechanism and the lower drive mechanism to act synchronously to push the door to translate.

Optionally, the upper drive mechanism includes an upper drive shaft, an upper shift fork fixed to the upper drive shaft, and an upper shaft seat, the upper shaft seat is fixed to the full side openable boxcar, the upper drive shaft is rotatable connected at two ends to the upper shaft seat, the middle drive mechanism is fixedly connected to the upper drive shaft, and the upper drive shaft drives the upper shift fork to push the upper part of the door to translate.

Optionally, a sub-fork configured to push the doors to translate from outside to inside of the upper shift fork is provided with an pressing fork, and the pressing fork tightly presses against the upper part of the door in a closing state of the doors.

Optionally, an abutment plate is fixedly connected to the upper part of the door, and the abutment plate protrudes from an upper end of the door, and has one side surface being in tightly-pressed contact with the pressing fork, and another side surface abutting against another sub-fork.

Optionally, the lower drive mechanism includes a lower drive shaft, a lower pusher fixed to the lower drive shaft and a lower shaft seat, the lower shaft is fixed to the full side openable boxcar, of the lower drive shaft has two ends rotatably connected to the lower shaft seat, the middle drive mechanism is fixedly connected to the lower drive shaft, and the lower drive shaft drives the lower pusher to push the lower part of the door to translate.

Optionally, the lower pusher is a three-track fork, the number of the doors is four, a pulley and a double-row slide rail configured to guide the pulley to slide are arranged at the bottom of the door, the pulley is provided with annular concave grooves matching with the sub-tracks of the three-track fork and the slide rails; in the closing state of the door, the three-track fork and the pulley are in one-to-one correspondence, and the pulley is located on an middle sub-track of the three-track fork; in the opening or closing state of the door, the middle sub-track and another sub-track are coupled to respective rows of the slide rail respectively.

Optionally, two of the opening and closing devices are mounted between two of the doors at a middle position to activate the doors adjacent to each other to translate in the inner-outer direction respectively.

Optionally, the middle drive mechanism includes an upper link, a lower link and a reversing shaft configured to connect the upper link and the lower link, the upper drive shaft is fixedly provided with an upper crank connected to the upper link, and the lower drive shaft is fixedly provided with a lower crank connected to the lower link.

Optionally, the upper link includes a first link fixed to the upper crank, a second link connected to the lower link, and a middle crank, the middle crank connects the first link and the second link which are arranged along a bending direction of the door.

Optionally, the middle drive device is provided with an operating handle configured to drive the upper drive mechanism and the lower drive mechanism to act synchronously.

Optionally, the full side openable boxcar further includes a manipulating lock device which is provided with a lock body, two lock cores and an elastic member, the elastic member is connected to a terminal end of each of the two lock cores, the lock body is provided with a mounting groove in which the two lock cores are arranged, a locking area, within which the operating handle on a corresponding side of the opening and closing device is locked, is enclosed by a head end of each of the lock cores, a bottom portion of the mounting groove and a side wall at the corresponding side, the head end moves with respect to the side wall of the mounting groove to lock and open the manipulating lock device.

Optionally, the lock body comprises a lock frame, lock cover and lock seat, the lock frame is provided with a U-shaped groove, one end of the lock cover and one end of the lock seat are fixed to opposite outer side surfaces of a bottom end of the U-shaped groove, the lock cover, the lock seat and the U-shaped groove form the mounting groove supporting and restraining the lock core, and a side wall of the U-shaped groove and the head end form the locking area.

A full side openable boxcar is provided according to the present application, which includes multiple doors and opening and closing devices each being configured to activate the opening and closing of the doors. Compared with the conventional technology, the doors are arranged sequentially to form one side wall of the full side openable boxcar, and each of the doors is moveable in a longitudinal direction of the car body of the boxcar; in other words, one side wall of the full side openable boxcar is composed of the doors which can be opened, and the doors at any positions can be opened. Therefore, the loading and unloading of cargoes can be directly performed at different positions of the boxcar, thus avoiding carrying work from an opening at the door after the cargoes are loaded on the boxcar or carrying work for transferring cargoes gradually from two ends of the car body to the door opening. In a closing state, the doors are arranged sequentially to be closed. When the doors are required to be opened, the opening and closing devices activate the doors to translate in an inner-outer direction, to allow the doors to be staggered, and then the doors are pushed to slide in a longitudinal direction of the car body, and with the doors overlapped with each other, the full side openable boxcar is gradually opened. The doors of the full side openable boxcar can be opened and closed simply and flexibly, thereby providing convenience for cargo loading and unloading, and effectively improving the efficiency of cargo loading and unloading.

Figure 1:
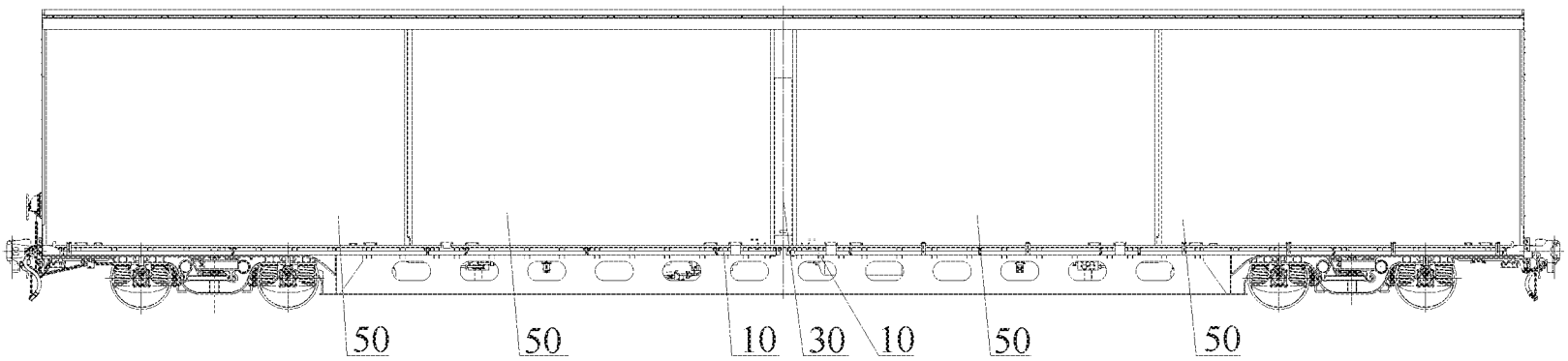
FIG. 1 is a schematic view showing the structure of a full side openable boxcar according to an embodiment.

In the drawings, the correspondence between the reference numerals in FIGS. 1 to 8 and component names are as follows:

| | |
|---|---|
| 10 opening and closing device, | |
| 11 upper drive mechanism, | |
| 111 upper drive shaft, | 112 upper shift fork, |
| 113 upper shaft seat, | 114 upper crank, |
| 115 abutment plate, | 116 nylon member; |
| 12 lower drive mechanism, | |
| 121 lower drive shaft, | 122 three-track fork, |
| 123 lower shaft seat, | 124 lower crank, |
| 125 a door stopper, | |
| 13 middle drive mechanism, | |
| 131 first link, | 132 second link, |
| 133 lower link, | 134 middle crank, |
| 135 reversing shaft, | 136 operating handle; |
| 20 manipulating lock device, | |
| 21 lock body, | 22 lock core, |
| 23 elastic member, | |
| 211 lock frame, | 212 lock cover, |
| 213 lock seat, | 221 lock pin, |
| 2121 oblong hole, | |
| 20A locking area, | |
| 50 door, | 51 pulley, |
| 30 middle pillar, | 40 drawing plate. |

DETAILED DESCRIPTION

The core of present application is to provide a full side openable boxcar, by optimizing the design of a door assembly, handiness and flexibility of door opening and closing is improved, thereby ensuring the improvement in efficiency of cargo loading and unloading.

For enabling those skilled in the art to more clearly understand the technical solution of the present application, the present application is further described in detail hereinafter in conjunction with the drawings and embodiments.

It should be noted that, the orientation words such as "inner", "outer", "upper" and "lower" herein are defined with respect to a railway boxcar. Specifically, "inner" refers to a direction towards an inside of the railway boxcar, that is, close to a central portion of a body of the boxcar; "outer" refers to a direction towards an outside of the railway boxcar, that is, away from the center of the car body; "upper" refers to a direction towards a top portion of the railway boxcar, and "lower" refers to a direction towards a bottom portion of the railway boxcar. It should be understood that, the orientation words are defined based on the habit in using the device, and should not affect the scope of the present application.

As shown in FIG. 1, a full side openable boxcar is provided according to the present application, which includes multiple doors 50, and opening and closing devices 10 each being configured to activate the opening and closing of the respective doors 50. Compared with the conventional technology, the doors 50 are arranged sequentially to form a side wall of the full side openable boxcar, and each of the doors 50 is moveable in a longitudinal direction of a car body of the boxcar. In other words, the side wall of the full side openable boxcar is composed of the doors 50 which are openable, and the doors can be opened at any positions. Therefore, cargoes can be directly loaded or unloaded at different positions of the boxcar, thus avoiding the carrying work after the cargoes are loaded on the boxcar from an opening at the door 50 or the work for transferring cargoes gradually from two to ends of the car body to the opening at the door 50. In a closing state, the doors 50 are arranged sequentially to be closed. When the doors 50 are required to be opened, the opening and closing devices 10 activate the doors 50 to translate in an inner-outer direction, to allow the doors 50 to be staggered, and then the doors 50 are pushed to slide in a longitudinal direction of the car body, and as the doors 50 are overlapped with each other, the full side openable boxcar is gradually opened. The doors 50 of the full side openable boxcar can be opened and closed simply and flexibly, thereby providing convenience for cargo loading and unloading, and effectively improving the efficiency of cargo loading and unloading.

In an embodiment, the full side openable boxcar is provided with double-row slide rails (not shown in the drawings) by which the doors 50 is slidable in the longitudinal direction of the car body. The number of the doors 50 is four, and two opening and closing devices 10 are mounted between two doors 50 at the middle to activate the doors 50 adjacent to each other to translate in the inner and outer directions respectively.

With this arrangement, the arrangement of doors 50 of the full side openable boxcar can be optimized, and simplicity and flexibility of cargo handing at different positions of the car body can be ensured.

Further, the full side openable boxcar utilizing the above structure can achieve a variety of ways for opening the doors. For example, by the opening and closing devices 10, two doors 50 at the middle position are simultaneously staggered with the remaining two doors 50 and then are slid to two ends of the car body, thus a middle position of the car body can be opened. The positions where the two ends of the car body are located may just be opened by sliding the doors 50 at the two ends to the middle position. Moreover, one end of the car body can be opened by sliding the two doors 50 at the middle position and one door 50 at the one end to the other end. Of course, there are ways for opening other positions, which simply requires to slide the doors 50 according to the requirement.

Further, the design of the opening and closing device 10 is optimized, reference may be specifically made to FIGS. 2 to 5.

Figure 2:
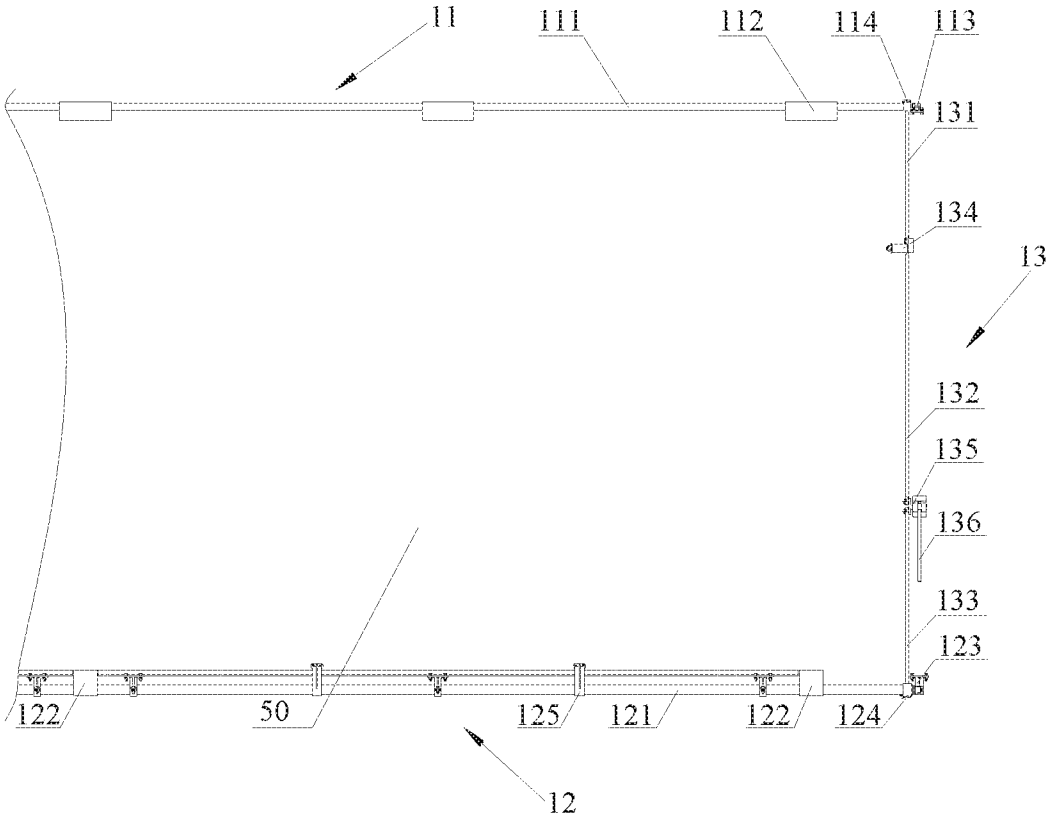
FIG. 2 is a schematic view showing the structure of an opening and closing device connected to a corresponding door when the door according to an embodiment is in a closing state.

In an embodiment, as shown in FIG. 2, the opening and closing device 10 includes an upper drive mechanism 11, a lower drive mechanism 12 and an middle drive mechanism 13. The upper drive mechanism 11 is arranged at an upper side of the door 50 and configured to push an upper part of the door 50 to translate in the inner-outer direction, the lower drive mechanism 12 is arranged at the lower side of the door 50 to push a lower part of the door 50 to translate in the inner-outer direction. The middle drive mechanism 13 has one end connected to the upper drive mechanism 11 and another end connected to the lower drive mechanism 12. With the middle drive mechanism 13, the upper drive mechanism 11 and the lower drive mechanisms 12 may be driven to move, to enable the upper and lower drive mechanisms 11, 12 together to push the door 50 to translate in the inner-outer direction.

In the process of opening the door 50, the opening and closing device 10 can push the upper and lower parts of the door 50 synchronously to translate smoothly in a direction from inside to outside, to allow the two doors 50 in a closing state to be staggered, and then push or pull one of the two doors 50 to achieve opening of the doors 50 of the full side openable boxcar. In the process of closing the door 50, the overlapped doors 50 reach a state in which they are completely separated from each other (arranged in the longitudinal direction of the car body), then the opening and closing device 10 pushes synchronously the upper and lower parts of the door 50 to translate from outside to inside, thereby closing a space between the two adjacent doors 50, and eventually completely closing the doors 50 of the full side openable boxcar. By the opening and closing device 10, in one aspect, the upper and lower parts of the door 50 may be pushed synchronously to achieve smooth translation of the door 50; and in another aspect, the translation of the door 50 in the inner-outer direction may be activated simply by the middle drive mechanism 13, thus the operation is simple and convenient.

The aforementioned synchronous action means that the upper drive mechanism 11 and the lower drive mechanism 12 push simultaneously corresponding parts of the door 50 from inside to outside or from outside to inside.

Figure 3:
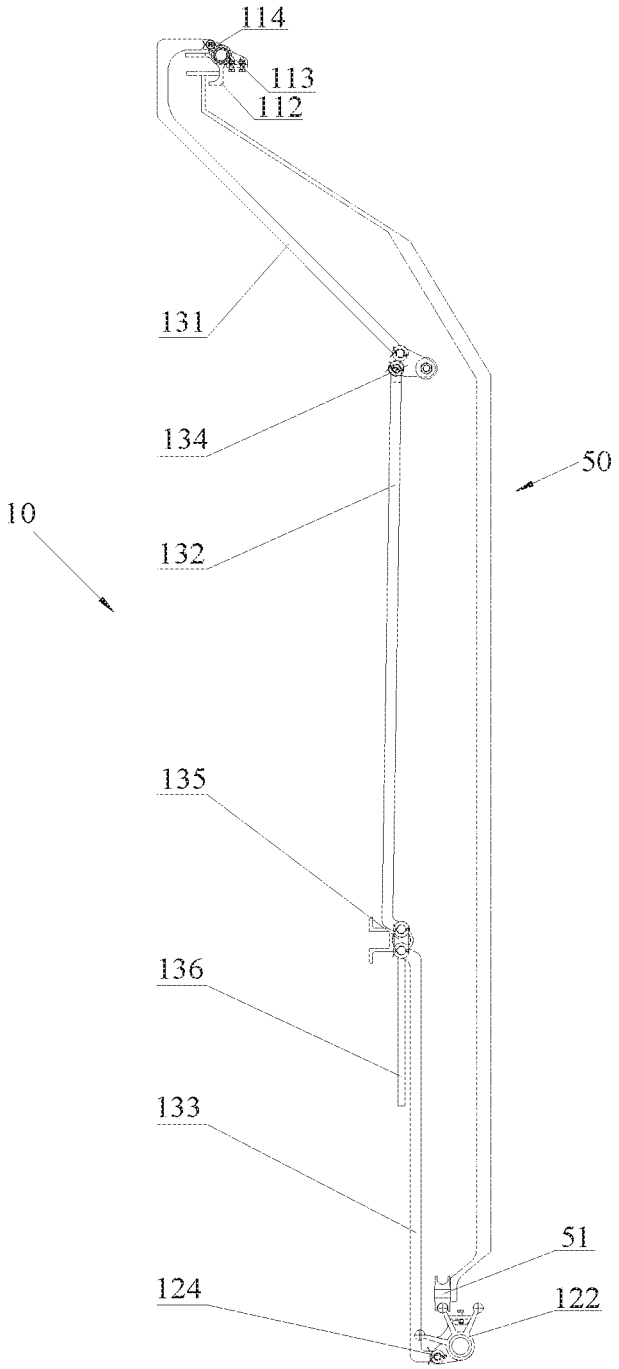
FIG. 3 is a side view of FIG. 2.
Figure 4:
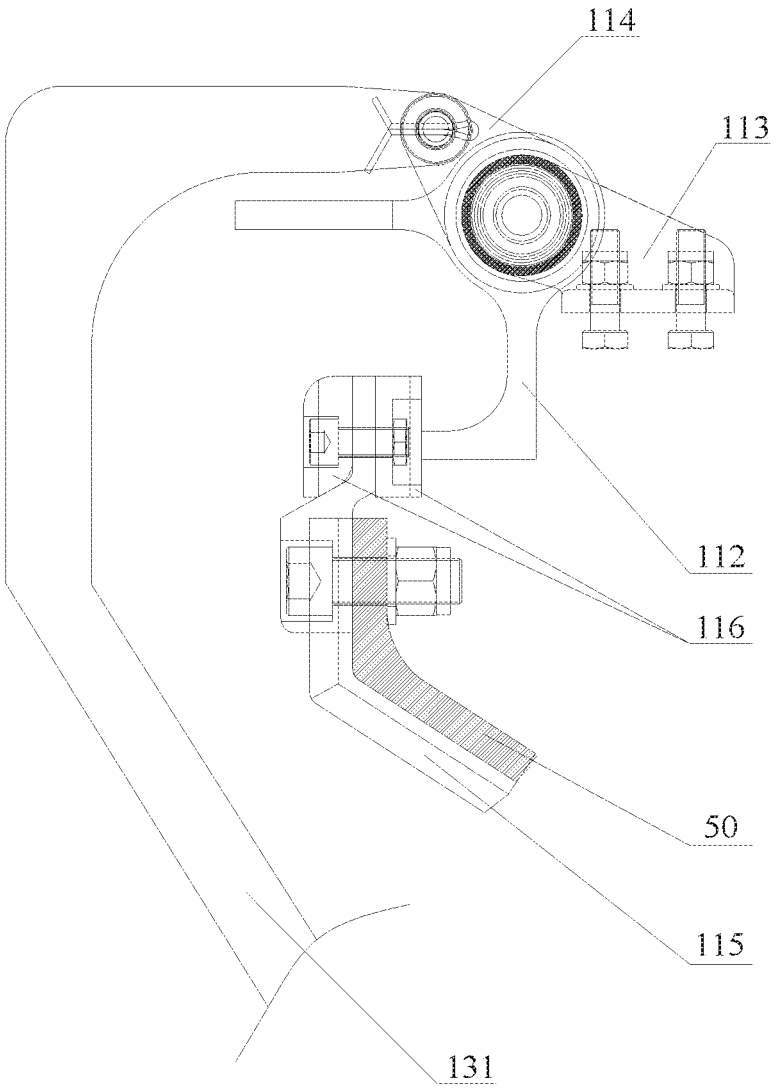
FIG. 4 is a schematic view showing the relationship between an upper shift fork and the door in FIG. 3.

As shown in FIGS. 3 and 4, the upper drive mechanism 11 includes an upper drive shaft 111, an upper pusher fixed on the upper drive shaft 111 and an upper shaft seat 113. Specifically, the upper shaft seat 113 is fixed to a steel structure of the full side openable boxcar to provide support for the upper drive mechanism 11. Two ends of the upper drive shaft 111 are respectively rotatable connected to the upper shaft seat 113, that is, the upper drive shaft 111 is rotatable with respect to the upper shaft seat 113 arranged at the two ends of the upper shaft seat 113. The middle drive mechanism 13 is fixedly connected to the upper drive shaft 111 to drive the upper drive shaft 111 to rotate, and drive the upper pusher to rotate and further drive the upper pusher to push the upper part of the door 50.

Figure 5:
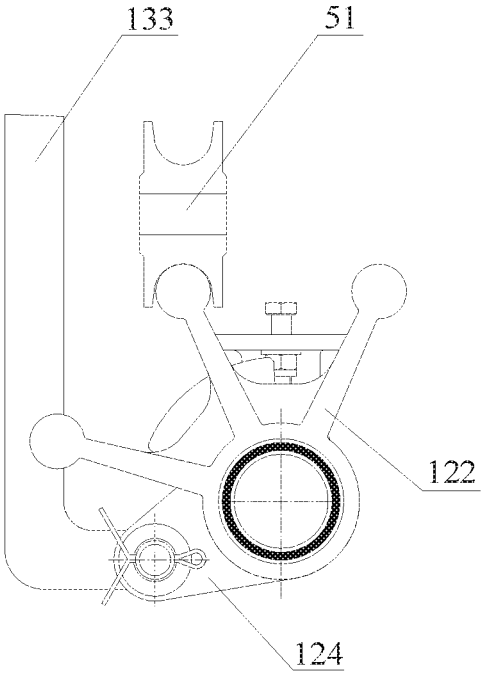
FIG. 5 is a schematic view showing the relationship between a three-track fork and the door in FIG. 3.

As shown in FIGS. 3 and 5, the design of the lower drive mechanism 12 is optimized. The optimized lower drive mechanism 12 includes a lower drive shaft 121, a lower pusher fixed on the lower drive shaft 121 and a lower shaft seat 123. The lower shaft seat 123 is fixed to the steel structure of the full side openable boxcar to provide support for the lower drive mechanism 12. Two ends of the lower drive shaft 121 are rotatable connected to the lower shaft seat 123, that is, the lower drive shaft 121 is rotatable with respect to the lower shaft seat 123 arranged at the two ends of the lower drive shaft 121. The middle drive mechanism 13 is fixedly connected to the lower drive shaft 121 to drive the lower drive shaft 121 to rotate, and drive lower pusher to rotate and further enable the lower pusher to push the lower part of the door 50. Thus, the lower drive mechanism 12 cooperates with the upper drive mechanism 11 to achieve the translation of the door 50.

As shown in FIG. 3, the design of the middle drive mechanism 13 is optimized. The optimized middle drive mechanism 13 includes an upper link, a lower link 133 and a reversing shaft 135 connecting the upper link and the lower link 133. The upper link of the middle drive mechanism 13 is connected to an upper crank 114 of the upper drive shaft 111, and the lower link 133 is connected to a lower crank 124 of the lower drive shaft 121.

The middle drive mechanism 13 is provided with an operating handle 136 which is arranged at the position of the reversing shaft 135. When the operating handle 136 is rotated, the upper link and the lower link 133 are provided with power for moving in corresponding directions under the action of the reversing shaft 135, such that the upper link drives the upper rotating shaft, and the lower link 133 drives the lower rotating shaft.

By the cooperation of the upper drive mechanism 11, the lower drive mechanism 12 and the middle drive mechanism 13 in the above embodiment, the translation of the doors 50 can be realized simply and conveniently.

The design of various mechanisms of the opening and closing device 10 is further optimized.

In an embodiment, the upper pusher is an upper shift fork 112, a sub-fork of the upper shift fork 112 pushing the door 50 to translate from outside to inside is provided with a pressing fork. In this way, after the upper shift fork 112 pushes the door 50 from outside to inside, the door 50 is in a closing state, and at this time, the pressing fork still tightly presses against the upper part of the door 50, so as to prevent the door 50 from translating to be opened due to wobbling of the car body, thereby ensuring the tightness of the closing of the door 50 effectively.

The pressing fork may be formed by bending a sub-fork on a corresponding side towards the door 50, or may also be welded to an end of the sub-fork. Further, the form of the pressing fork is not limited to the structure form in the embodiment, as long as the pressing fork can tightly press against the upper part of the door 50 and ensure a reliable closing.

Further, an abutment plate 115 is fixedly connected to the upper part of the door 50. The abutment plate 115 protrudes from an upper end of the door 50, with a protruding end having a side surface which is in a tightly-press contact with the pressing fork, and another side surface abutting against another sub-fork of the upper shift fork, that is, the upper shift fork 112 pushes the door 50 by pushing the abutment plate 115 fixed to the upper part of the door 50. With this arrangement, the movement of the door 50 can be realized by the repeated abutment and pulling between the abutment plate 115 and the upper shift fork 112, which can, in one aspect, protect the door 50 and avoid the damage to the door 50 caused by being repeatedly pulled by the upper shift fork 112, and in another aspect, may further ensure a certain space between the upper end of the door 50 and the upper drive shaft 111 to prevent the door 50 from interfering with the upper link and other components.

A nylon member 116 is fixed on each of two side surfaces of the abutment plate 115 and is configured to contact with the upper shift fork 112 to avoid fierce collision, thus service lives of the upper shift fork 112 and the abutment plate 115 are prolonged.

The lower pusher is a three-track fork 122 including three sub-tracks. At the bottom portion of the door 50, a pulley 51 which is slidable along the sub-tracks and double-row slide rails configured to guide the pulley 51 to slide are arranged. The pulley 51 of the door 50 is provided with inner-concave annular grooves matching with the sub-tracks of the three-track fork 122 and the slide rails. In this way, movement of the pulley 51 in the inner-outer direction can be restricted by the sub-tracks.

In the closing state, all of the pulleys 51 of the door 50 are located on a sub-track at a middle position, in this case, the sub-track at the middle position of the three-track fork 122 is coupled to an inner slide rail of the door 50, and an outer sub-track of the three-track fork 122 is coupled to an outer slide rail of the door 50. When the door 50 is translated from inside to outside, the three-track fork 122 is rotated outwardly under the action of the lower drive shaft 121, such that the sub-track at the middle position is coupled to the outer slide rail of the door 50, and an inner sub-track of the three-track fork 122 is coupled to the inner slide rail of the door 50.

With this arrangement, track switching of the corresponding door 50 can be realized by the three-track fork 122, and the door 50 is pushed to move in the inner-outer direction. In addition, the double-row slide rails of the door 50 may be maintained in the coupled state in real time, thereby ensuring the sliding of the door 50 along the car body.

The number of the three-track fork 122 may be set to two, three or more. The specific number and arrangement position of the three-track fork 122 should be set according to the pulley 51 of the door 50. Specifically, the number of the three-track fork 122 is the same as that of the pulley 51, and the arrangement position of the three-track fork 122 should exactly correspond to the respective pulley 51 in the closing of the door 50. With this arrangement, the translation of the door 50 driven by the three-track fork 122 can be realized stably and reliably.

In a specific embodiment, a door stopper 125 is fixed to the lower drive shaft 121, the door stopper 125 abuts against an outer side of the door 50, thus further ensuring limit to the position of the door 50, thereby effectively preventing the movement of the door 50 when the position-limiting function of the three-track fork 122 fails or becomes unstable.

The upper link includes a first link 131, a second link 132 and a middle crank 134. Specifically, the first link 131 is fixedly connected to the upper crank 114, the second link 132 is connected to the lower link 133, and the middle crank 134 connects the first link 131 and the second links 132. Each of the first link 131 and the second link 132 is rotatable about the middle crank 134 to transmit the power of the middle drive mechanism 13.

Further, as shown in FIG. 3, the first link 131 and the second link 132 are arranged along a bending direction of the door 50, that is, the first link 131 and the second link 132 are arranged substantially close to an inner plate of the door 50. In this way, angles of the upper part of the door 50 can be effectively utilized and therefore, the maximum cargo space of the full side openable boxcar can be increased.

An upper segment of the first link 131 is bent twice successively towards the door 50, such that the end of the first link 131 is connected to the upper crank 114 to prevent connection interference.

As shown in FIG. 5, a lower end of the lower link 133 is bent to be connected to the lower crank 124 to reduce an operating force of the operating handle 136 and further improve the force condition, which makes the operation more simple and convenient.

An included angle between a horizontal plane and a connecting line, which is between a connection center of the lower crank 124 and the lower bent segment and a rotation center of the lower pusher, is half of a rotation angle of the lower pusher. With this arrangement, the connection center when the door 50 is closed is located in a same vertical direction as the connection center when the door 50 is pushed to the outer slide rail, which further improves the force condition, and reduces the operating force of the operating handle 136.

The rotation angle of the lower pusher refers to an angle by which the lower pusher turns when the door 50 is pushed from the inner slide rail in the closing state to the outer slide rail.

In view of the above embodiments, the full side openable boxcar further includes a manipulating lock device 20 configured to control the operating handle 136 of the opening and closing device 10 to be in a locked state, thus improving the stability of the closed and opening states of the door 50.

Figure 6:
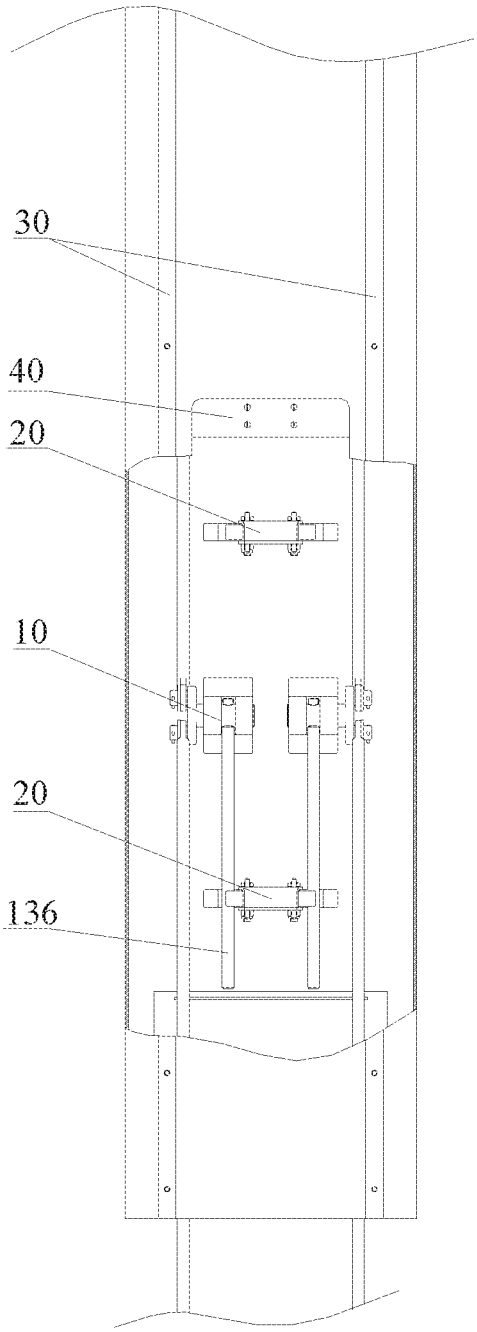
FIG. 6 is a schematic view showing an operating handle locked by a manipulating lock device of the full side openable boxcar according to an embodiment.
Figure 7:
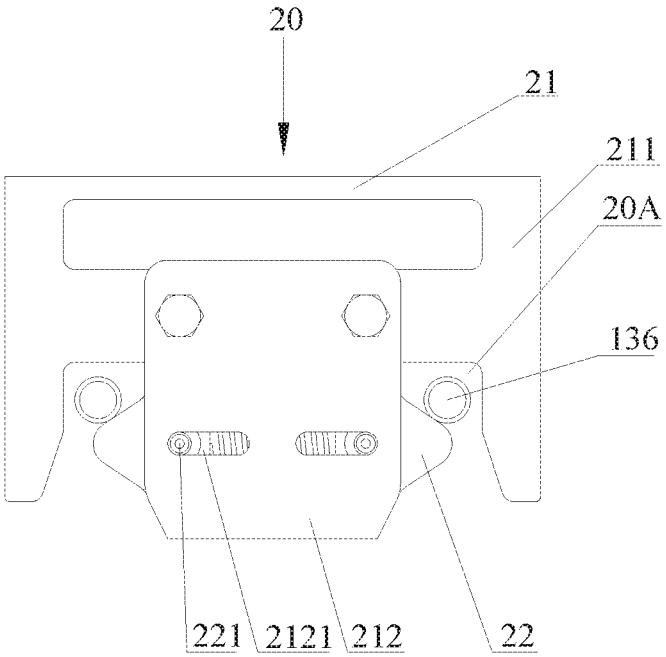
FIG. 7 shows the manipulating lock device in FIG. 6.
Figure 8:
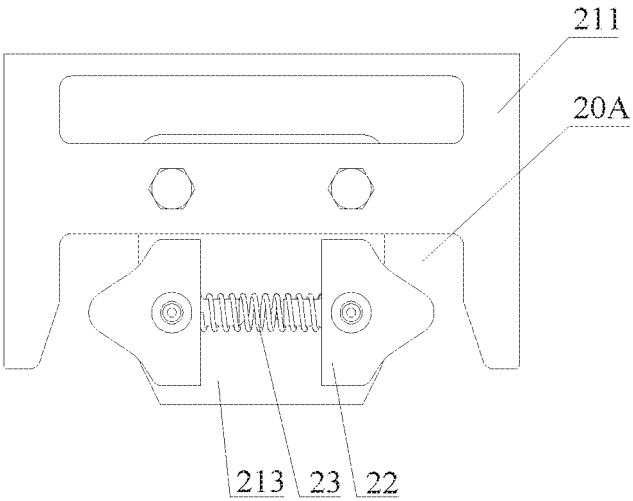
FIG. 8 is a schematic view showing the internal structure of the manipulating lock device.

The manipulating lock device 20 is described in detail in conjunction with FIGS. 6 to 8.

As shown in FIG. 6, two operating handles 136 are locked by the manipulating lock device 20, thus movement of the drive mechanism is further restricted, thereby ensuring that the door 50 is in a stable and full closing state. When being rotated to a position for opening the door 50, the operating handles 136 are also locked within the manipulating lock device 20 mounted at this position.

The manipulating lock device 20 includes a lock body 21, two lock cores 22 and an elastic member 23. Specifically, the elastic member 23 is connected to an end of each of the two lock cores 22 to enable the two lock cores 22 to move in opposite directions under the action of the elastic member 23. The lock body 21 is provided with two mounting grooves in which the two lock cores 22 are arranged, the two lock cores 22 are restricted and moveable in the mounting grooves. A locking area 20A, within which the operating handle 136 on a corresponding side is locked, is enclosed by a head end of each of the lock cores 22, a bottom portion and a side wall at of the mounting groove the corresponding side.

When being rotated to the manipulating lock device 20, the operating handle 136 touches and pushes the lock core to move it towards the direction of the other lock core, and presses the elastic member 23 tightly, thereby opening the manipulating lock device 20 and allowing the operating handle 136 to enter into the locking area 20A. After the locking area 20A enters into the locking area 20A, the operating handle 136 is separated from the head end of the lock core, and the lock core is rapidly moved to the locking position under the action of a restoring force of the elastic member 23, so as to restrict the operating handle 136 within the locking area 20A reliably. In this way, when vibration occurs to the full side openable boxcar or when the operating handle 136 is subjected to an impact, the operating handle 136 can still be restricted within the locking area 20A stably, thereby preventing large rotation from occurring and effectively ensuring stability of closing and opening of the door 50.

Further, the design of the lock core is optimized. The head end of the optimized lock core is provided with an arc surface configured to guide the operating handle 136 to slide into or out of the locking area 20A. With this arrangement, by the arc surface of the head end cooperating with the operating handle 136 of a cylinder shape, the smoothness and gentleness of the locking and opening processes can be improved.

The aforementioned lock body 21 includes a lock frame 211, a lock cover 212 and a lock seat 213. The lock frame 211 is provided with a U-shaped groove, one end of the lock cover 212 and one end of the lock seat 213 are respectively fixed on opposite outer side surfaces of a bottom end of the U-shaped groove. As shown in FIGS. 7 and 8, the lock cover 212 and the lock seat 213 of the lock body 21 are fixed to the bottom side surfaces of the U-shaped groove, and the lock cover 212 and the lock seat 213 are arranged oppositely to cover part of a side opening of the U-shaped groove. The lock cover 212, the lock seat 213 and the U-shaped groove form the mounting groove for supporting and restraining the lock core, and side walls of the U-shaped groove and the respective head end form the locking area 20A, that is, the side wall of the U-shaped groove is the aforementioned corresponding side wall which encloses the locking area 20A together with the bottom portion of the mounting groove and the respective head end of the lock cores 22. In locking or opening process, the lock core can extend out of or retract into an edge of the lock cover 212. With this arrangement, the lock core can be effectively supported to stably move, thus the stability in the locking and opening processes is improved.

According to an embodiment, one side surface of each lock core is provided with a lock pin 221, and the lock cover 212 is provided with a guide groove into which the lock pin 221 is inserted. As shown in FIG. 6, in the locked state, the lock pin 221 is pressed against an inner wall of an end portion of the guide groove, thereby restraining the lock core in a position to lock the operating handle 136. When unlocking is required, the operating handle 136 is manually rotated to touch the head end of the lock core and push the lock core, and the lock pin 221 moves along the guide groove to guide the two lock cores to move close to each other and retract under the lock cover 212 so as to open the manipulating lock device 20. After the operating handle 136 is separated from the head end of the lock core, the lock pin 221 accurately and stably moves to the end of the guide groove along the guide groove under the action of the elastic member 23, thus restoring to the locking state, in this way, the accuracy and stability of the movement of the lock core is improved.

Further, the guide groove includes two oblong holes 2121 which guide and restrain the lock pins 221 on corresponding sides, respectively. With such an arrangement, interference may be avoided when the two lock pins 221 move close to each other.

A length of each of the oblong holes 2121 is equal to a stroke of the lock core from a locking position to an unlocking position. In this way, not only the locking position is further ensured, but also a retracted position of the lock core is restricted, that is, an opening position of the manipulating lock device 20 is ensured.

Meanwhile, two ends of the oblong hole 2121 are semicircular arc surfaces respectively, which are easy to machine, and can fit the cylindrical lock pin 221 to prevent damage caused by collision.

In order to prevent the operating handle 136 from sliding out of the locking area 20A under a slight force and ensure that the operating handle 136 is completely locked by the manipulating lock device 20, the elastic member 23 is set to have a predetermined compression amount in the locking state and thus is capable of pushing the lock core towards a locking direction, such that the lock core can retract under the lock cover 212 to open the manipulating lock device 20 only under a certain opposite force.

The elastic member 23 may be a spring, or may also be an elastic strip or elastic components of other forms.

The full side openable boxcar is also provided with a drawing plate 40, and two central pillars 30 are provided with rails for insertion and withdrawing of the drawing plate 40. When it is not required to operate the operating handle 136 of the drive mechanism, the drawing plate 40 may be pulled along the rails to cover the manipulating lock device 20 and the operating handle 136. In other words, a box configured to accommodate the manipulating lock device 20 and the operating handle 136 is formed by the drawing plate 40, a wall plate and the two central pillars 30, to function as a protective device.

Each of the doors 50 of the full side openable boxcar is embodied as a door 50 having a aluminum alloy profile structure, which has a small dead weight, a strong capability in withstanding outward expansion, a good manufacturability and an aesthetic appearance.

The full side openable boxcar according to the present application is described in detail hereinabove. The present application is illustrated herein by specific examples. The above description of examples is only intended to help the understanding of the method and core concept of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. A full side openable boxcar, comprising:

a plurality of doors which are movable in a longitudinal direction of a car body of the boxcar, and opening and closing devices each being configured to activate opening and closing of the respective doors;

wherein in a closing state, the doors are arranged sequentially to form a side wall of the full side openable boxcar; and in an opening state, the opening and closing devices activate the doors to translate in an inner-outer direction to allow the doors to be staggered and moved in the longitudinal direction of the car body, to open a corresponding position of the full side openable boxcar;

wherein each of the opening and closing devices comprises an upper drive mechanism arranged at an upper side of the door to push an upper part of the door to translate in the inner-outer direction;

the upper drive mechanism comprises an upper drive shaft and an upper shift fork fixed to the upper drive shaft; and a sub-fork of the upper shift fork configured to push the doors to translate from outside to inside is provided with a pressing fork, and the pressing fork tightly presses the upper part of the door in the closing state of the doors.

2. The full side openable boxcar according to claim 1, wherein the opening and closing devices further comprises:

a lower drive mechanism arranged below the door to push a lower part of the door to translate in the inner-outer direction; and a middle drive mechanism which has one end connected to the upper drive mechanism and another end connected to the lower drive mechanism, wherein the middle drive mechanism drives the upper drive mechanism and the lower drive mechanism to act synchronously to push the respective door to translate.

3. The full side openable boxcar according to claim 2, wherein the middle drive device is provided with an operating handle configured to drive the upper drive mechanism and the lower drive mechanism to act synchronously.

4. The full side openable boxcar according to claim 2, wherein the upper drive mechanism further comprises upper shaft seats;

the upper shaft seats are fixed to the full side openable boxcar, two ends of the upper drive shaft are rotatably connected to the upper shaft seats respectively, the middle drive mechanism is fixedly connected to the upper drive shaft, and the upper drive shaft drives the upper shift fork to push the upper part of the door to translate.

5. The full side openable boxcar according to claim 4, wherein the lower drive mechanism comprises a lower drive shaft, a lower pusher fixed to the lower drive shaft, and lower shaft seats;

the lower shaft seats are fixed to the full side openable boxcar, the lower drive shaft has two ends rotatably connected to the lower shaft seats respectively, the middle drive mechanism is fixedly connected to the lower drive shaft, and the lower drive shaft drives the lower pusher to push the lower part of the door to translate.

6. The full side openable boxcar according to claim 5, wherein the lower pusher is a three-track fork, the number of the doors is four, a pulley and a double-row slide rail configured to guide the pulley to slide are arranged at a bottom of each door, the pulley is provided with an annular inner-concave groove matching with the sub-tracks of the three-track fork and the slide rail;

in the closing state of the door, the three-track fork and the pulley are in one-to-one correspondence, and the pulley is located on a middle sub-track of the three-track fork; and in the opening or closing state of the door, the middle sub-track and another sub-track are coupled to the respective rows of the slide rail.

7. The full side openable boxcar according to claim 6, wherein two of the opening and closing devices are mounted between two of the doors at middle positions to activate the doors adjacent to each other to translate in the inner-outer direction respectively.

8. The full side openable boxcar according to claim 5, wherein the middle drive mechanism comprises an upper link, a lower link and a reversing shaft configured to connect the upper link and the lower link; and the upper drive shaft is fixedly provided with an upper crank connected to the upper link, and the lower drive shaft is fixedly provided with a lower crank connected to the lower link.

9. The full side openable boxcar according to claim 8, wherein the upper link comprises a first link fixed to the upper crank, a second link connected to the lower link, and a middle crank, the middle crank connects the first link and the second link which are arranged along a bending direction of the door.

10. The full side openable boxcar according to claim 1, further comprising a manipulating lock device which is provided with a lock body, two lock cores and an elastic member, wherein the elastic member is connected to an end of each of the two lock cores, the lock body is provided with a mounting groove in which the two lock cores are arranged, a locking area, within which the operating handle on a corresponding side of the opening and closing device is locked, is enclosed by a head end of each of the lock cores, a bottom portion of the mounting groove and a side wall at the corresponding side, the head end moves with respect to the side wall of the mounting groove to lock or open the manipulating lock device.

11. The full side openable boxcar according to claim 10, wherein the lock body comprises a lock frame, a lock cover and a lock seat, the lock frame is provided with a U-shaped groove, one end of the lock cover and one end of the lock seat are fixed to opposite outer side surfaces of a bottom end of the U-shaped groove respectively, the lock cover, the lock seat and the U-shaped groove form the mounting groove supporting and restraining the lock core, and a side wall of the U-shaped groove and the head end form the locking area.

12. The full side openable boxcar according to claim 1, wherein an abutment plate is fixedly connected to the upper part of the door, and the abutment plate protrudes out of an upper end of the door, and has one side surface being in tightly-pressed contact with the pressing fork and another side surface abutting against another sub-fork.

13. The full side openable boxcar according to claim 12, wherein the lower drive mechanism comprises a lower drive shaft, a lower pusher fixed to the lower drive shaft, and lower shaft seats;

the lower shaft seats are fixed to the full side openable boxcar, the lower drive shaft has two ends rotatably connected to the lower shaft seats respectively, the middle drive mechanism is fixedly connected to the lower drive shaft, and the lower drive shaft drives the lower pusher to push the lower part of the door to translate.

* * * * *